US005991935A

United States Patent [19]

Wang

[11] Patent Number: 5,991,935

[45] Date of Patent: Nov. 30, 1999

[54] RESILIENT TOILET SEAT DEVICE

[76] Inventor: Shih Kai Wang, No. 50-5, Pu Wei Lane, Tou Ren Li, Lu Gang Town, Chang Hua Hsien, Taiwan

[21] Appl. No.: 09/063,862

[22] Filed: Apr. 21, 1998

[51] Int. Cl.[6] ..... A47K 13/24

[52] U.S. Cl. ..... 4/234; 4/237; 4/242.1

[58] Field of Search ..... 4/237, 234, 239, 4/242.1

[56] References Cited

U.S. PATENT DOCUMENTS 3,379,800 4/1968 Wert ..... 4/237 X
3,513,050 5/1970 Samuels et al. ..... 4/237 X
3,949,432 4/1976 Ginsburg ..... 4/237
4,155,127 5/1979 Seiderman ..... 4/237 X

*Primary Examiner*—Henry J. Recla
*Assistant Examiner*—Kathleen J. Prunner

[57] ABSTRACT

A toilet seat device includes a seat having a base, a soft insert disposed on the base, an outer cover layer engaged on the insert and having a peripheral flange, and a frame secured to the base for securing the peripheral flange of the outer cover layer to the base and for solidly securing the insert between the base and the outer cover layer. The frame has one or more positioning pins for engaging with the base and for positioning the frame relative to the base. The base includes a bottom recess for receiving the frame. A cover is pivotally coupled to the seat and includes a soft insert.

7 Claims, 5 Drawing Sheets

RESILIENT TOILET SEAT DEVICE

BACKGROUND OF THE INVENTION

1. Field of the Invention

The present invention relates to a toilet seat, and more particularly to a resilient toilet seat.

2. Description of the Prior Art

Typical toilet seat devices comprise a seat and a cover pivotally coupled together. However, the seat and the cover are both made of plastic material and include a great hardness such that the user may not feel comfortable. In addition, the user may feel cold when using such plastic seat. In order to solve such problems, some of the users use woven cloth to make a cover layer for covering the seat. However, the cover layer may not be solidly secured to the seat and may be easily removed from the seat. In addition, it will be difficult for the users themselves to make such cover layer for the seat.

The present invention has arisen to mitigate and/or obviate the afore-described disadvantages of the conventional toilet seats.

SUMMARY OF THE INVENTION

The primary objective of the present invention is to provide a toilet seat device having a resilient insert for allowing the user to feel more comfortable.

In accordance with one aspect of the invention, there is provided a toilet seat device comprising a seat for securing to a toilet, the seat including a base, an insert disposed on the base and having an outer peripheral portion, an outer cover layer engaged on the outer peripheral portion of the insert and having at least one peripheral flange, and means for securing the at least one peripheral flange of the outer cover layer to the base, the insert being solidly secured between the base and the outer cover layer when the at least one peripheral flange of the outer cover layer is secured to the base.

The securing means includes a frame engaged with the base, and means for securing the frame to the base, the at least one peripheral flange of the outer cover layer is engaged and secured between the base and the frame. The frame includes at least one positioning pin for engaging with the base and for positioning the frame relative to the base. The base includes a bottom recess for receiving the frame.

The base includes a plurality of reinforcing ribs for reinforcing purposes and for engaging with the insert and for positioning the insert relative to the base.

A cover is further pivotally coupled to the seat and includes a base, an insert disposed on the base of the cover and having an outer peripheral portion, an outer cover layer engaged on the outer peripheral portion of the insert of the cover and having at least one peripheral flange, and means for securing the at least one peripheral flange of the outer cover layer to the base of the cover.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
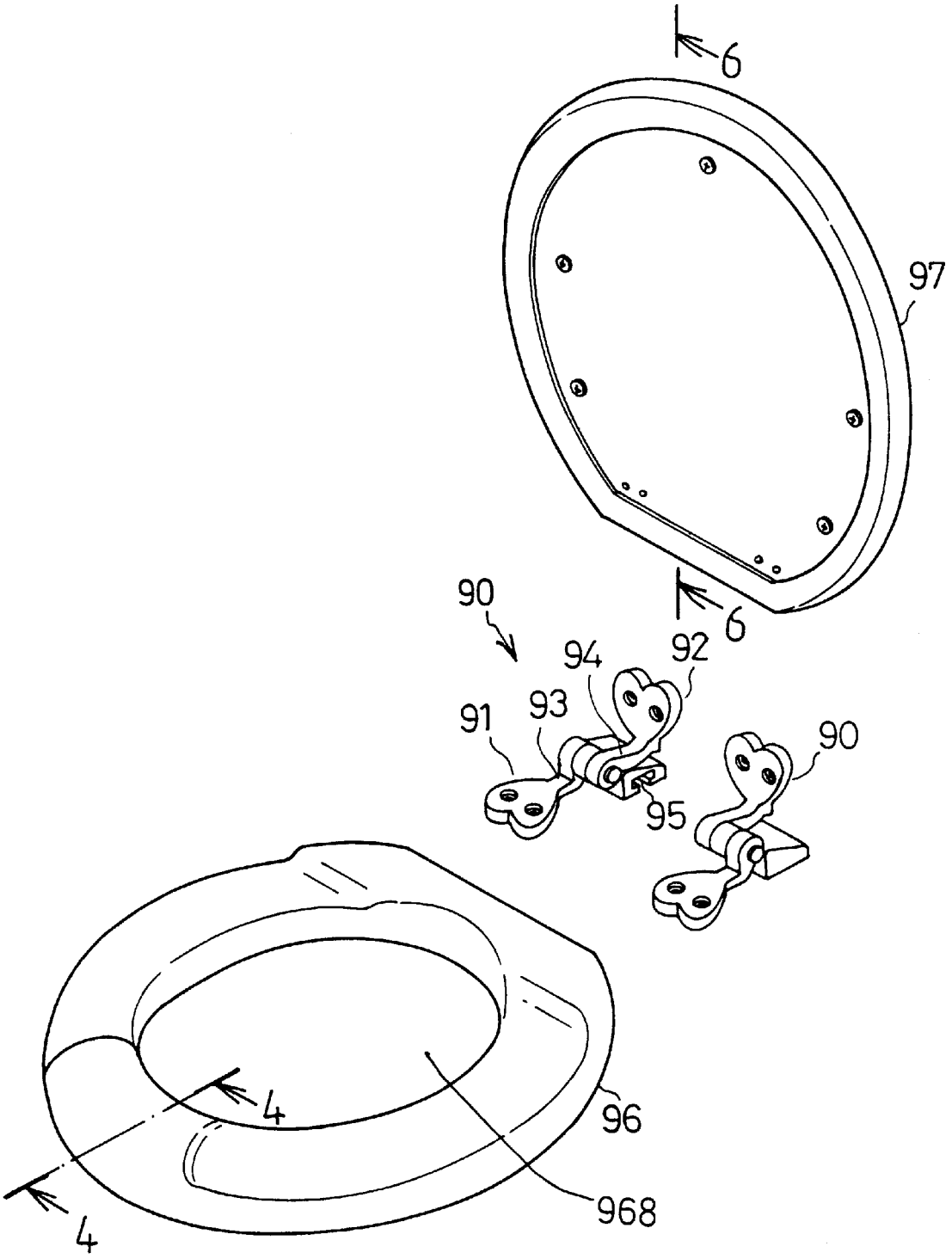
FIG. 1 is an exploded view of a toilet seat device in accordance with the present invention.
Figure 2:
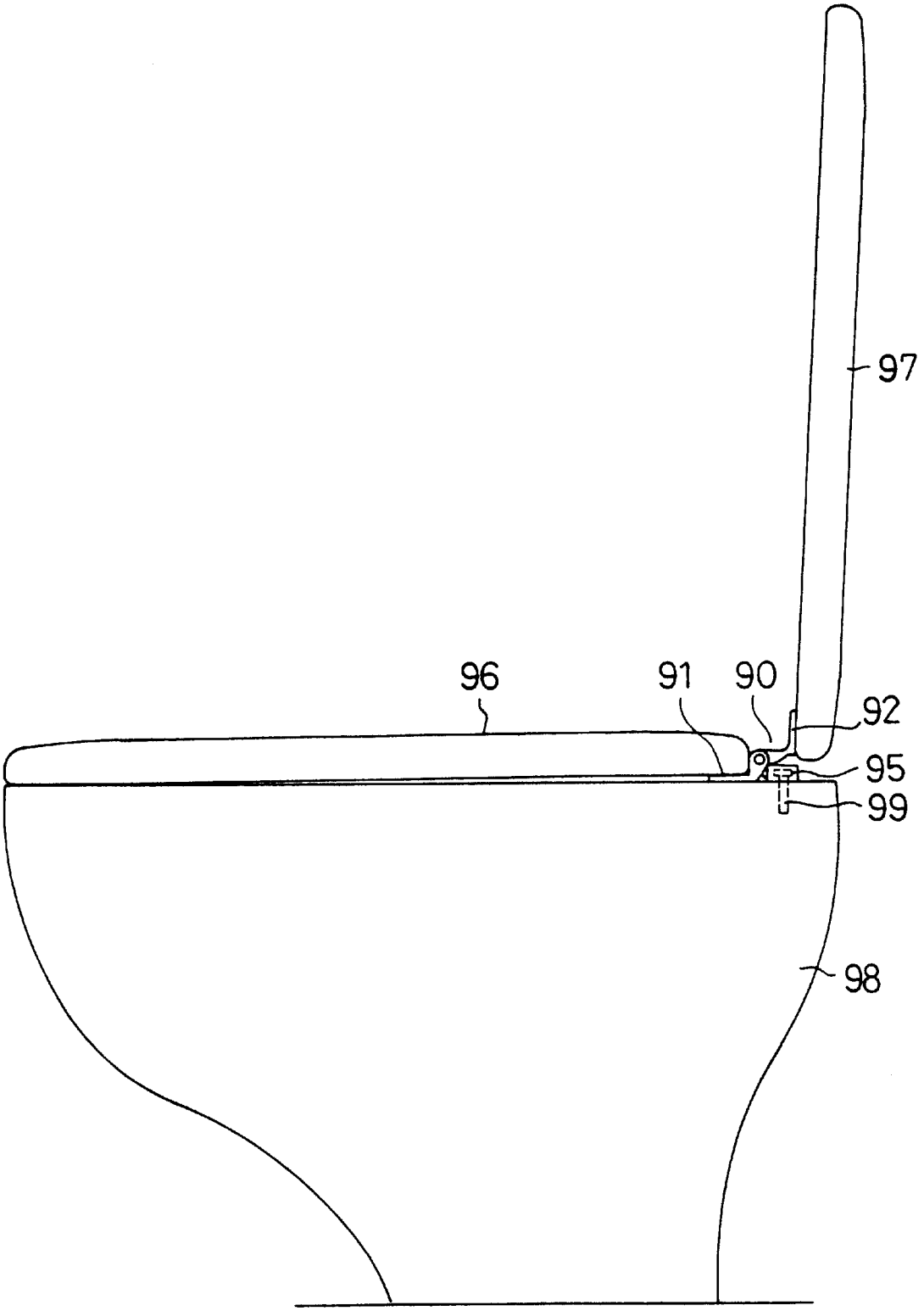
FIG. 2 is a side view of a toilet.

Referring to the drawings, and initially to FIGS. 1 and 2, a toilet seat device in accordance with the present invention comprises a seat 96 and a cover 97 pivotally coupled together by hinges 90 which are secured to the bowl 98 by bolts 99. The seat 96 includes an opening 968 formed therein.

Figure 3:
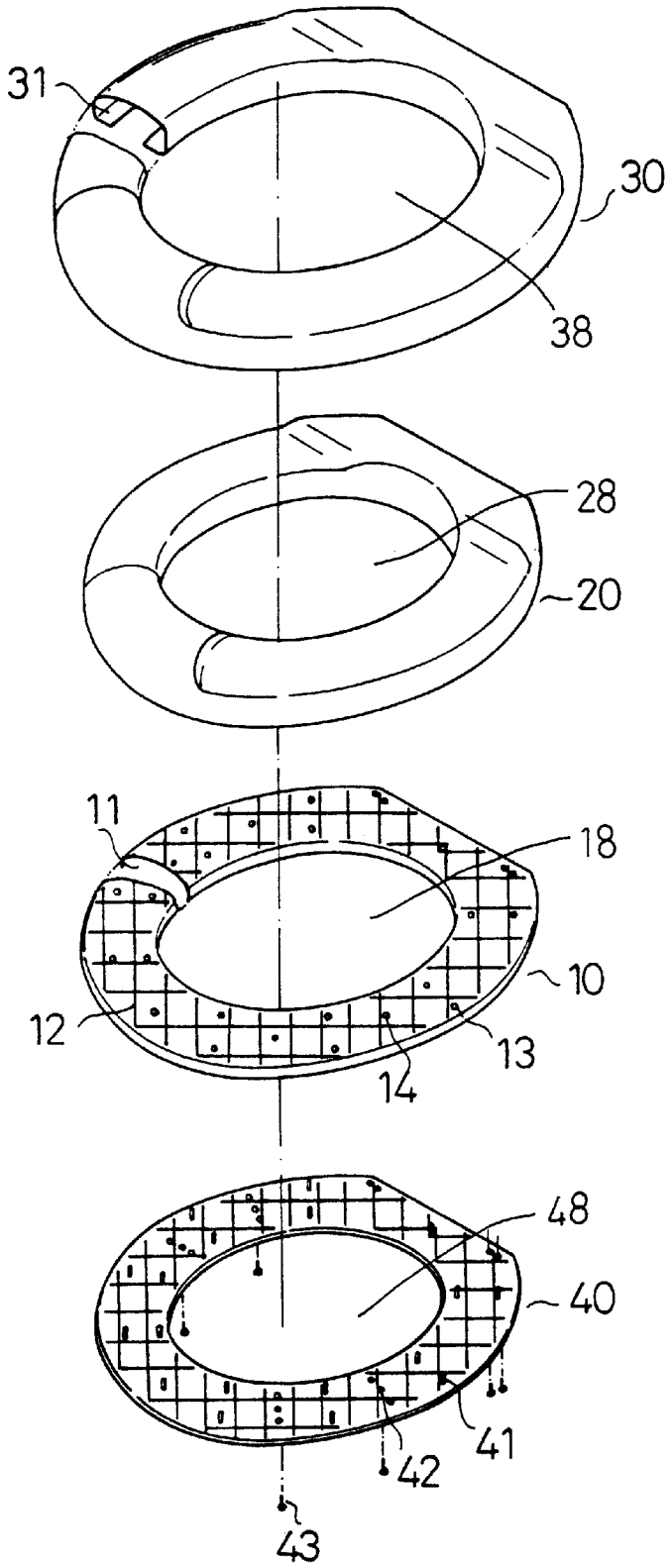
FIG. 3 is an exploded view of the seat.
Figure 4:
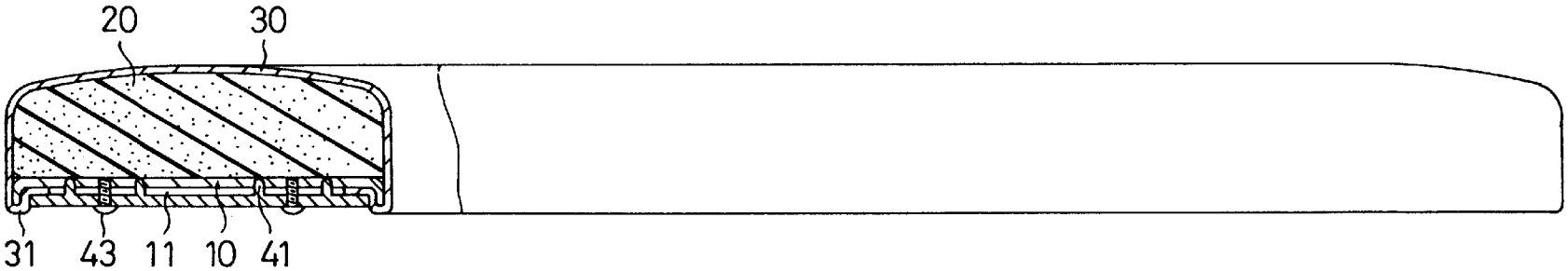
FIG. 4 is a cross sectional view taken along lines 4—4 of FIG. 1.

Referring next to FIGS. 3 and 4, the seat 96 includes a base 10 preferably made of harder materials, such as plastic material. The base 10 includes a number of reinforcing ribs 12 for reinforcing purposes and includes a number of holes 13, 14 and includes an annular recess 11 formed in the bottom for engaging with a frame 40. An insert 20 is disposed on the base 10 and is preferably made of soft material, such as spongy material or foamable material. The ribs 12 may be used for engaging into the soft insert 20 and for stably positioning the insert 20 relative to the base 10. A outer cover layer 30 is preferably made of flexible material, such as woven cloth, leather product or synthetic leather or rubber, plastic film etc. The outer cover layer 30 is engaged onto the outer and upper peripheral portion of the insert 20 by such as hot-pressing process and includes a pair of peripheral flanges 31 extended toward each other and engaged between the base 10 and the frame 40. The frame 40 includes a number of positioning pins 41 engaged with the holes 14 of the base 10 and includes a number of holes 42 for engaging with fasteners 43 which may secure the frame 40 to the base 10 and which may solidly secure the peripheral flanges 31 of the outer cover layer 30 in place. The base 10, the insert 20, the outer cover layer 30 and the frame 40 each includes an opening 18, 28, 38, 48 for forming the opening 968 of the seat 96.

Figure 6:
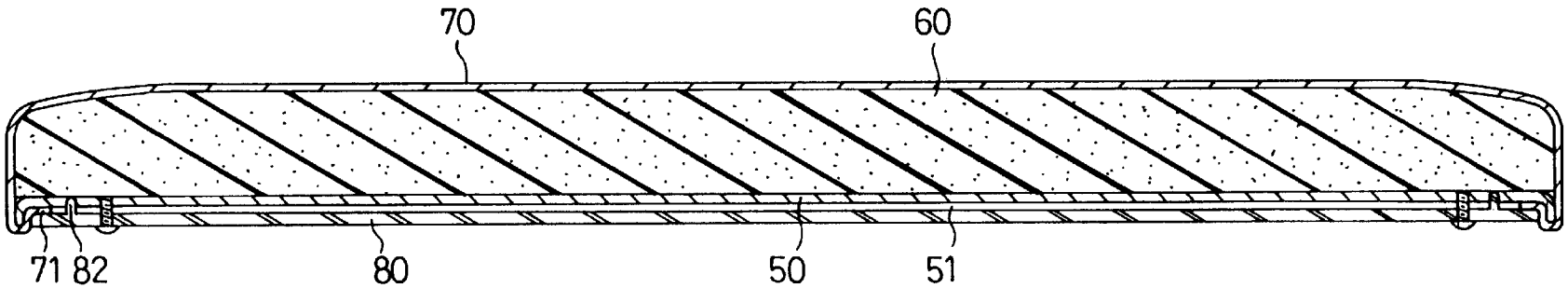
FIG. 6 is a cross sectional view taken along lines 6—6 of FIG. 1.
Figure 5:
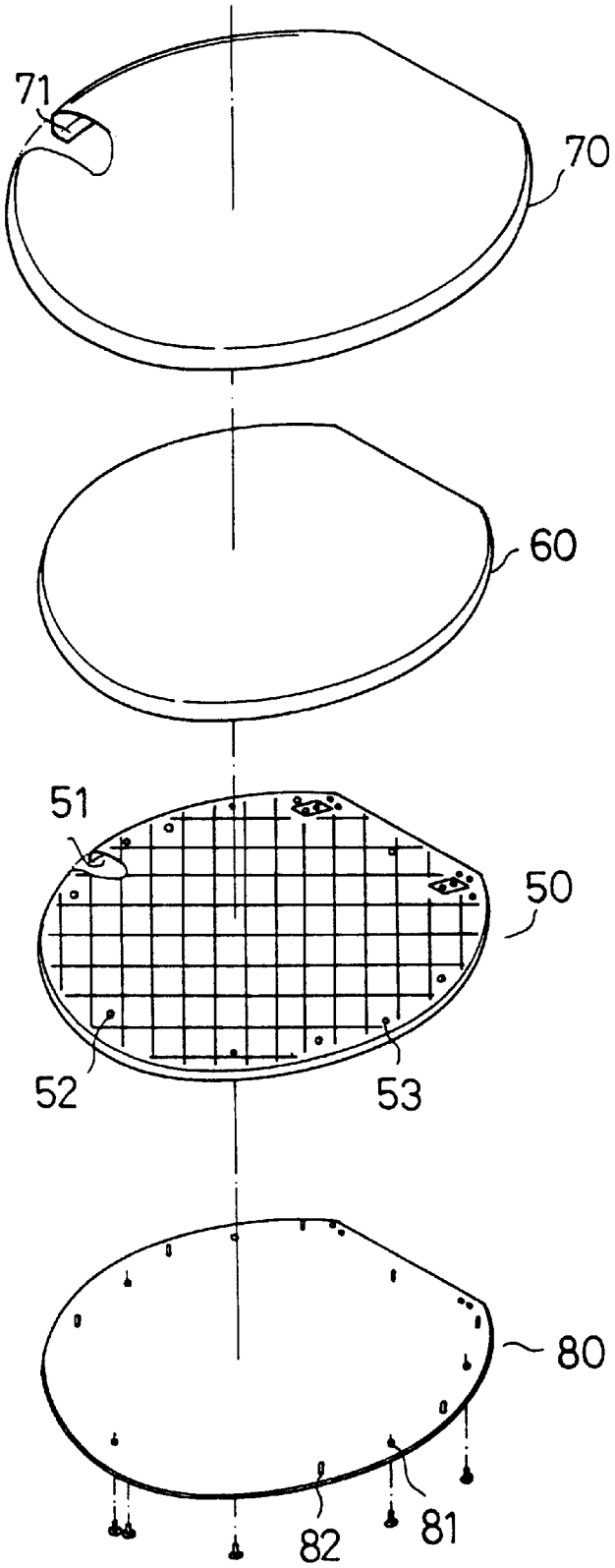
FIG. 5 is an exploded view of the cover.

Referring next to FIGS. 5 and 6, the cover 97 also includes a base 50, an insert 60 of soft material disposed above the base 50, an outer cover layer 70 engaged on the insert 60, and a frame 80 secured to the base 50 by fasteners which are engaged through the holes 81 of the frame 80. The base 50 includes a recess 51 for engaging with the frame 80 and includes a number of holes 52 for engaging with the fasteners and includes a number of holes 53 for engaging with the positioning pins 82 of the frame 80. The outer cover layer 70 includes a peripheral flange 71 extended between the base 50 and the frame 80 for being secured in place by the base 50 and the frame 80.

Referring again to FIGS. 1 and 2, the seat 96 and the cover 97 of soft material may include a greater size. Accordingly, the two arms 91, 92 of the hinges 90 each includes an extension 93, 94 for allowing the cover 97 to be folded relative to the base 96. The hinges 90 each includes a channel 95 for engaging with the fasteners 99 and for securing the toilet seat device to the bowl 98.

It is to be noted that the outer cover layers 30, 70 are solidly engaged onto the insert 20, 60 by hot-pressing process and may not be easily moved and disengaged relative to the insert 20, 60. In addition, the outer cover layers 30, 70 each includes a flange engaged in and secured between the base and the frame. Normally, the user will not be seated on the cover 97 such that the cover 97 may be optionally made with the soft insert 60.

Accordingly, the toilet seat device in accordance with the present invention includes a structure having a resilient insert for allowing the user to feel more comfortable.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A toilet seat device comprising:

a seat for securing to a toilet, said seat including a base, an insert disposed on said base and having an outer peripheral portion, an outer cover layer engaged on said outer peripheral portion of said insert and having at least one peripheral flange, and means for securing said at least one peripheral flange of said outer cover layer to said base, said insert being solidly secured between said base and said outer cover layer when said at least one peripheral flange of said outer cover layer is secured to said base, said securing means including a frame engaged with said base, and means for securing said frame to said base, said at least one peripheral flange of said outer cover layer being engaged and secured between said base and said frame, said base including a bottom recess for receiving said frame.

2. The toilet seat device according to claim 1, wherein said frame includes at least one positioning pin for engaging with said base and for positioning said frame relative to said base.

3. The toilet seat device according to claim 1, wherein said base includes a plurality of reinforcing ribs for reinforcing purposes and for engaging with said insert and for positioning said insert relative to said base.

4. The toilet seat device according to claim 1 further comprising a cover and means for pivotally coupling said cover to said seat, said cover including a base, an insert disposed on said base of said cover and having an outer peripheral portion, an outer cover layer engaged on said outer peripheral portion of said insert of said cover and having at least one peripheral flange, and means for securing said at least one peripheral flange of said outer cover layer to said base of said cover.

5. The toilet seat device according to claim 4, wherein said securing means includes a frame engaged with said base of said cover, and means for securing said frame of said cover to said base of said cover, said at least one peripheral flange of said outer cover layer is engaged and secured between said base of said cover and said frame of said cover.

6. A toilet seat device comprising:

a seat for securing to a toilet, said seat including a base, an insert disposed on said base and having an outer peripheral portion, an outer cover layer engaged on said outer peripheral portion of said insert and having at least one peripheral flange, and means for securing said at least one peripheral flange of said outer cover layer to said base, said insert being solidly secured between said base and outer cover layer when said at least one peripheral flange of said outer cover layer is secured to said base, a cover, and means for pivotally coupling said cover to said seat, said cover including a base, an insert disposed on said base of said cover and having an outer peripheral portion, an outer cover layer engaged on said outer peripheral portion of said insert of said cover and having at least one peripheral flange, and means for securing said at least one peripheral flange of said outer cover layer to said base of said cover, said securing means including a frame engaged with said base of said cover, and means for securing said frame of said cover to said base of said cover, said at least one peripheral flange of said outer cover layer is engaged and secured between said base of said cover and said frame of said cover, said frame of said cover including at least one positioning pin for engaging with said base of said cover.

7. A toilet seat device comprising:

a seat for securing to a toilet, said seat including a base, an insert disposed on said base and having an outer peripheral portion, an outer cover layer engaged on said outer peripheral portion of said insert and having at least one peripheral flange, and means for securing said at least one peripheral flange of said outer cover layer to said base, said insert being solidly secured between said base and said outer cover layer when said at least one peripheral flange of said outer cover layer is secured to said base, a cover, and means for pivotally coupling said cover to said seat, said cover including a base, an insert disposed on said base of said cover and having an outer peripheral portion, an outer cover layer engaged on said outer peripheral portion of said insert of said cover and having at least one peripheral flange, and means for securing said at least one peripheral flange of said outer cover layer to said base of said cover, said securing means including a frame engaged with said base of said cover, and means for securing said frame of said cover to said base of said cover, said at least one peripheral flange of said outer cover layer is engaged and secured between said base of said cover and said frame of said cover, said base of said cover including a bottom recess for receiving said frame of said cover.

* * * * *